United States Patent [19]

Bradley

[11] 4,211,146

[45] Jul. 8, 1980

[54] RIFLE GUN BARREL

[76] Inventor: Richard L. Bradley, 6602 Bowie Dr., Springfield, Va. 22150

[21] Appl. No.: 865,226

[22] Filed: Dec. 28, 1977

[51] Int. Cl.[2] ..... F41F 17/08

[52] U.S. Cl. ..... 89/16

[58] Field of Search ..... 89/16, 15, 14.1; 42/79 R, 79 A

[56] References Cited

U.S. PATENT DOCUMENTS

| | | | |
|---|---|---|---|
| 153,294 | 7/1874 | Allen | 89/16 |
| 1,070,826 | 8/1913 | Lung | 89/14 A |
| 1,401,010 | 12/1921 | Summers | 89/16 |
| 1,543,262 | 6/1925 | Methlin | 89/14 A |
| 1,986,837 | 1/1935 | McCann et al. | 89/16 |
| 2,447,091 | 8/1948 | Pope | 42/76 R |
| 2,467,372 | 4/1949 | De Permentier | 89/14 A |

FOREIGN PATENT DOCUMENTS

| | | | |
|---|---|---|---|
| 127282 | 6/1919 | United Kingdom | 89/14 A |

OTHER PUBLICATIONS

Henry A. Bethell, Modern Guns and Gunnery 1910, pp. 63–75.

*Primary Examiner*—Stephen C. Bentley

[57] ABSTRACT

To increase the strength, rigidity and accuracy of a rifle gun barrel, a multi-part composite rifle barrel is created by enclosing the inner rifled tube with an outer sleeve, the two fastened together in a way that introduces compression in the outer part and tension in the inner part. The tension in the inner part increases the barrel's rigidity and reduces its vibration, thus increasing the accuracy of the rifle.

5 Claims, 10 Drawing Figures

RIFLE GUN BARREL

DESCRIPTION

In FIG. 1, the gun barrel, No. 1, is surrounded by a sleeve No. 2.

In FIG. 2, the gun barrel, No. 1A, is surrounded by a tightly compressed coil spring, No. 3.

In FIG. 3, the gun barrel, No. 1B is threaded to the outer sleeve, No. 2A, with a slight differential thread (with 20.0025 threads per inch for No. 1B and 20.0000 threads per inch for No. 2A, there would be a total change in length of 0.060 inches for a twenty-four inch barrel).

Figure 1:
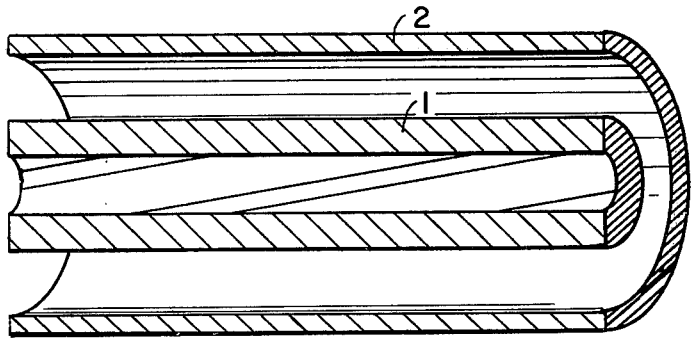
Figure 2:
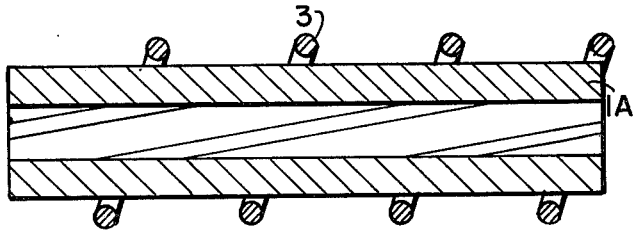
Figure 3:
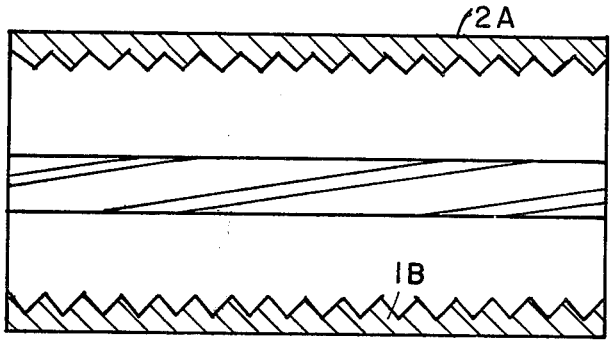
Figure 4:
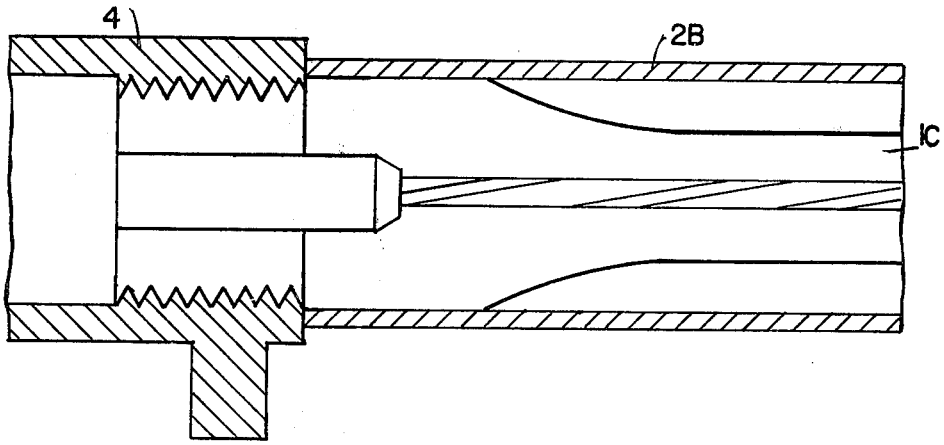
FIG. 4 shows the gun barrel No. 1C, surrounded by the tensioning sleeve No. 2B, screwed into a receiver or frame No. 4. In this case, the rear of the sleeve bears directly on the receiver.
Figure 5:
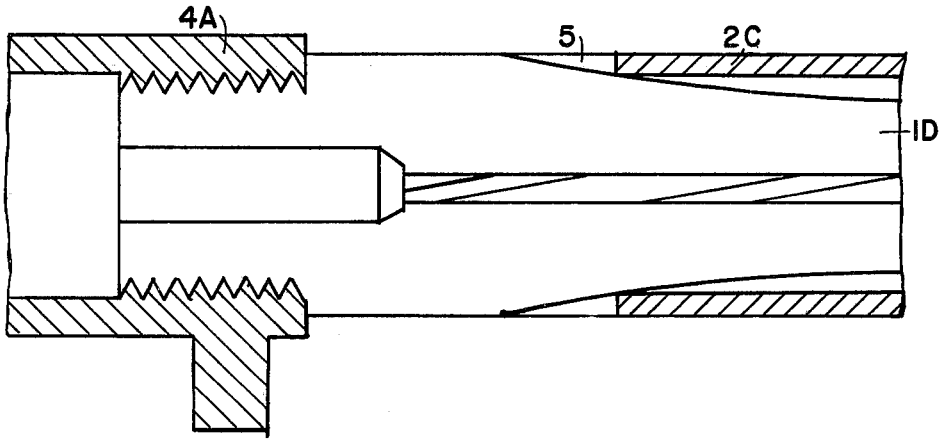
FIG. 5 shows the gun barrel, No. 1D, with the sleeve, No. 2C, bearing on a collar, No. 5, the whole screwed into a receiver, No. 4A.
Figure 6:
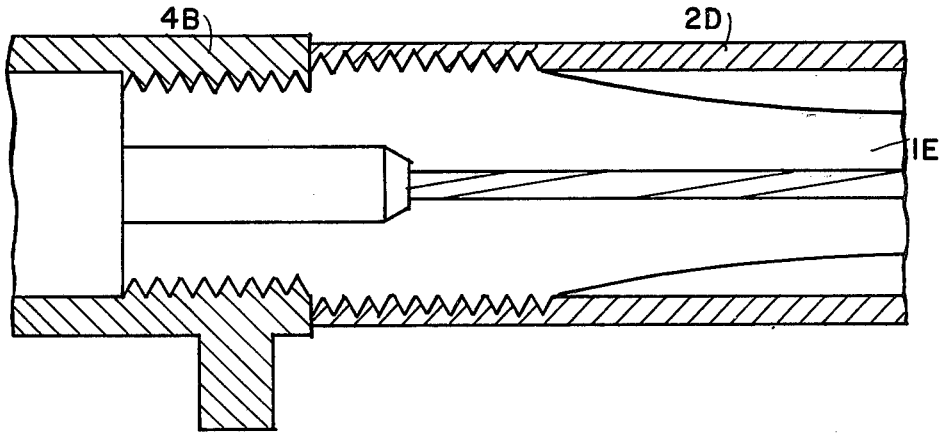
FIG. 6 shows the gun barrel, No. 1E, threaded into its sleeve, No. 2D, with the whole screwed into a receiver, No. 4B.
Figure 7:
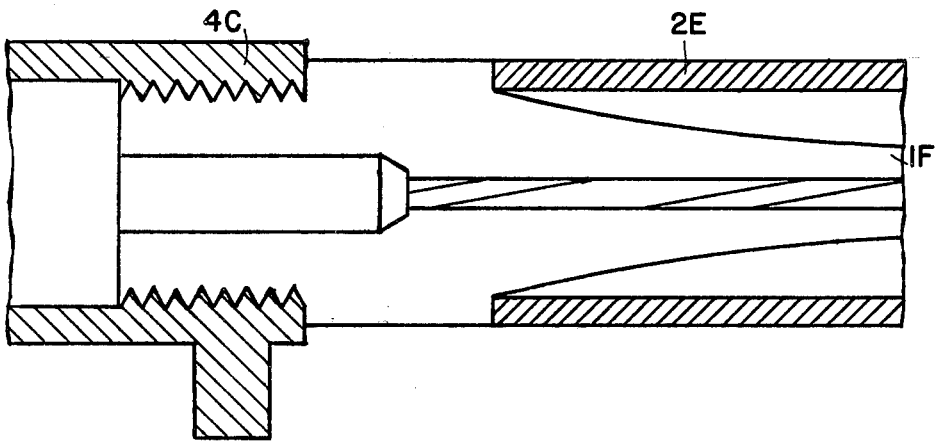
FIG. 7 shows the gun barrel, No. 1F, with the sleeve, No. 2E, bearing on a shoulder machined on the barrel, the whole being screwed into a frame or receiver, No. 4C.
Figure 8:
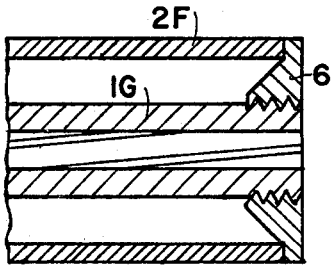
FIG. 8 shows the muzzle end of the rifle barrel, No. 1G, with the sleeve, No. 2F, being restrained by a threaded nut, No. 6.
Figure 9:
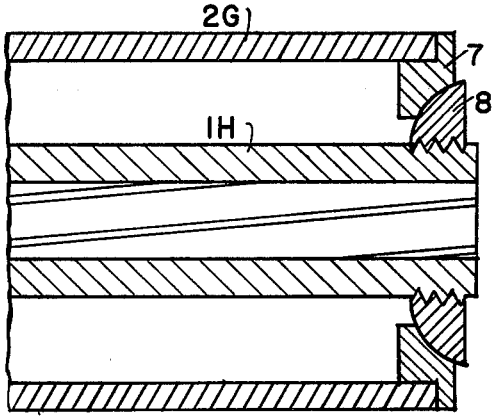
FIG. 9 shows the muzzle end of the barrel, No. 1H, with its sleeve, No. 2G, a bushing, No. 7, being restrained by a spherical surface nut, No. 8, to allow rotation of the muzzle relative to the sleeve.
Figure 10:
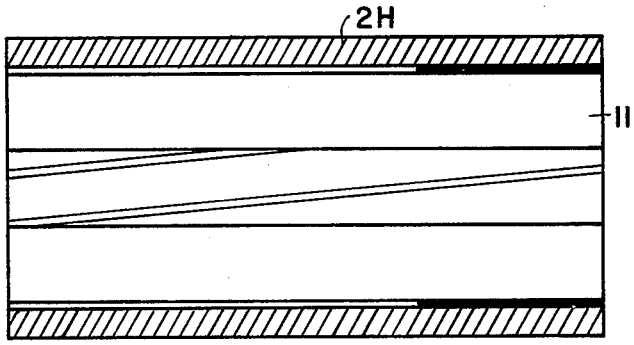
FIG. 10 shows the muzzle end of the barrel, No. 1I, with its sleeve, No. 2H, the two being brazed, soft soldered, epoxied or otherwise fastened together.

The exact detail of constructing or mounting of the outer sleeve is not important to the essence of this patent application. The outer sleeve can be a spring, tube or other such mechanism. It can be screwed to the barrel, either directly or through a bushing or adaptor. It can bear on the receiver, on a shoulder machined on the barrel or on a collar or similar way. It can be screw adjustable or not. It can be removable or permanently fastened, as by brazing or welding.

The outer sleeve can be substantially larger than the barrel, or just large enough to slip over the barrel. It can be straight or tapered. It can be square, round or other shapes. It can be solid or perforated. All of these variations are unimportant to the concept of a rifled tube placed in tension by an outer compression member.

DISCUSSION

This invention relates to improvements in firearms and more particularly to an improved rifle barrel having increased accuracy, i.e. reduced dispersion of bullets about the desired impact point on the target. The accuracy of a firearm is dependent on several factors, one of which is the vibration of the barrel while the bullet is transiting the barrel. While there has been little, if any, basic research as to the nature of these vibrations, it is conceded by experimenters and specialists in interior ballistics (from chamber to muzzle) that rifle barrels vibrate during the bullets passage. One author[1] likens the passage of the bullet down the barrel to a python swallowing a pig, which would suggest a longitudinal component to vibration, in addition to the accepted transverse and torsional vibrations.

[1] Edward D. Lowry, *Interior Ballistics*, pg. 107 Doubleday, 1968

Many patents have been issued to inventors for devices to "control" or "dampen" these vibrations. For a partial list, see Appendix A. All of these inventions, for one reason or another, fall short of the desired goal, namely, a barrel which will place all shots through a single hole in the target. The best accuracy available today is from very heavy, and consequently very rigid, barrels. The strength of these heavy barrels is far in excess of that required to contain the virtually explosive forces of the burning powder gases. The weight of such heavy rifles almost precludes their use outside target ranges.

This invention improves the ordinary rifle barrel by the use of an outer sleeve, which when fastened to the rifle barrel and compressed, as shown in the figures, applies a tensile force to the barrel, creating a stress in it and a consequent strain or elongation. The tension created in the barrel must be large enough so that the stress/strain relationship created in the barrel is larger than that experienced in the barrel during the bullets passage. Thus the force imposed by the sleeve elongates the barrel more than the elongation due to the bullets passage. The maximum, or peak, barrel elongation becomes the additive elongation from the stress due to the sleeve and the stress due to firing. As the stress of firing increases, the stress in the sleeve decreases, so the barrel elongation tends to remain more uniform (elongation at rest compared to elongation during firing).

This tension and its ensuing elongation is favorable in several ways. First, it raises the natural frequency of vibration, thereby lowering the amplitude of the vibration. Second, the sleeve provides a constraint or restriction to transverse vibrations at the muzzle. Third, the absolute longitudinal elongation of the barrel during the bullets passage is reduced to nearly zero. Collectively, these increase the barrels rigidity and decreases its susceptability to the adverse effects of vibration, thereby greatly increasing the accuracy of the barrel.

The complete barrel is then a composite of the inner rifled tube and the outer compression sleeve. The two units together comprise a functioning barrel system, each contributing to the advantages of strength, light weight, ridigity and accuracy. The sleeve becomes a part of the barrel.

The sleeve increases the rigidity of the barrel without a commensurate increase in weight. The sleeve also acts to contain the forces of the burning gases in the event of a rupture of the barrel, thereby maintaining a high factor of safety.

As the outer sleeve is in compression it acts as a column, for which a round tube is the most structurally efficient. The measure of column rigidity is the ratio of its length to its "radius of gyration" (the square root of its moment of inertia divided by its area).

The superiority of the axially stressed barrel can be illustrated by comparison with the conventional rifle barrel; to wit: immediately prior to discharge the only stress in the rifled barrel is that due to unrelieved internal stresses of manufacture and the influence of gravity on its cantilever design (assuming a horizontal position). Upon firing, the powder gases exert pressure on the base of the bullet, which then moves down the barrel, accelerating as it goes. Internal gas pressure may exceed 50,000 lbs/sq.in. The bullet is of groove size, and is forced into the rifling of the barrel which is bore size. Longitudinal, transverse (in 2 axes) and rotational stresses are included in the barrel, causing extremely small, but violent motions (vibrations) in the barrel. The violence of these motions is exhibited by the marked change in bullet impact obtained when a rifle sighted in with a sandbag rest under the forearm is fired with the barrel resting on a hard object such as a rock[2]. The composite barrel described herein greatly minimizes the strain or distortion due to the stresses of firing, by the prior imposition of a tensioning force in the barrel by the sleeve thereby minimizing adverse vibrations.

[2] "Barrel Rest Affects Impact and Grouping", *The American Rifleman*, August 1970, pg 38

I claim:

1. A composite rifle gun barrel formed of a rifled inner tube and an outer sleeve, with the rear of the outer sleeve bearing on the rifle receiver and the front of the outer sleeve bearing on a bushing and a spherical nut threaded to the muzzle of the inner tube, so that the outer sleeve is in compression and the inner tube is in tension.

2. A composite rifle gun barrel formed of a rifled inner tube and an outer sleeve, with the rear of the outer sleeve bearing on a collar or ring in the chamber area of the inner tube and the front of the outer sleeve bearing on a bushing and a spherical nut threaded to the muzzle of the inner tube, so that the outer sleeve is in compression and the inner tube is in tension.

3. A composite rifle gun barrel formed of a rifled inner tube and an outer sleeve, with the rear of the outer sleeve threaded to the rear or chamber area of the inner tube and the front of the outer sleeve bearing on a bushing and a spherical nut threaded to the muzzle of the inner tube, so that the outer sleeve is in compression and the inner tube is in tension.

4. A composite rifle gun barrel formed of a rifled inner tube and an outer sleeve with the rear of the outer sleeve bearing on a shoulder at the rear of the inner tube and the front of the outer sleeve bearing on a bushing and a spherical nut threaded to the muzzle of the inner tube, so that the outer sleeve is in compression and the inner tube is in tension.

5. A composite rifle gun barrel formed of a rifled inner tube and an outer sleeve, with the two threaded together with a differential pitch thread so that the outer sleeve is in compression and the inner tube is in tension.

* * * * *